US007847781B2

(12) United States Patent
Lai

(10) Patent No.: US 7,847,781 B2
(45) Date of Patent: Dec. 7, 2010

(54) FLAT DISPLAY CAPABLE OF ENHANCED RESOLUTION AND DISPLAY PANEL THEREOF

(75) Inventor: Chih-Chang Lai, Taichung County (TW)

(73) Assignee: Wintek Corporation, Taichung (TW)

( * ) Notice: Subject to any disclaimer, the term of this patent is extended or adjusted under 35 U.S.C. 154(b) by 804 days.

(21) Appl. No.: 11/822,596

(22) Filed: Jul. 9, 2007

(65) Prior Publication Data

US 2008/0024403 A1 Jan. 31, 2008

(30) Foreign Application Priority Data

Jul. 10, 2006 (TW) ..... 95125142 A

(51) Int. Cl.
*G09G 3/36* (2006.01)

(52) U.S. Cl. ..... 345/100; 345/103

(58) Field of Classification Search ..... 345/84, 345/95, 98, 100, 103, 206, 213; 324/770; 365/230.02

See application file for complete search history.

(56) References Cited

U.S. PATENT DOCUMENTS

| | | | | |
|---|---|---|---|---|
| 5,392,292 | A * | 2/1995 | Davis et al. | 714/7 |
| 6,853,364 | B2 * | 2/2005 | Kai et al. | 345/100 |
| 6,927,754 | B2 * | 8/2005 | Lai | 345/100 |
| 6,965,365 | B2 * | 11/2005 | Nakamura | 345/87 |
| 2004/0008173 | A1 * | 1/2004 | Maeda et al. | 345/99 |

* cited by examiner

*Primary Examiner*—Chanh Nguyen
*Assistant Examiner*—Pegeman Karimi
(74) *Attorney, Agent, or Firm*—Rabin & Berdo, P.C.

(57) ABSTRACT

A flat display includes a substrate, a pixel matrix, a data driver and a number of bias apparatuses. The pixel matrix is disposed on the substrate and includes several columns of first pixels and several columns of second pixels, wherein each column of second pixels is located between two adjacent columns of first pixels. The data driver is for outputting a plurality of data signals to the columns of first pixels. The bias apparatuses are disposed on the substrate, and respectively coupled to the columns of second pixels. Each of the bias apparatuses outputs a bias data signal to the corresponding column of second pixels according to the two data signals outputted to the two columns of first pixels adjacent to the corresponding column of second pixels.

18 Claims, 7 Drawing Sheets

FLAT DISPLAY CAPABLE OF ENHANCED RESOLUTION AND DISPLAY PANEL THEREOF

This application claims the benefit of Taiwan application Serial No. 95125142, filed Jul. 10, 2006, the subject matter of which is incorporated herein by reference.

BACKGROUND OF THE INVENTION

1. Field of the Invention

The invention relates in general to a flat display, and more particularly to a voltage-driven flat display capable of enhancing resolution.

2. Description of the Related Art

Increasing resolution of display images and reducing hardware cost is an essential subject of a flat display industry for competitiveness improvement. A conventional apparatus for improving display resolution requires extra memory for driving output and display of a driving integrated circuit (IC), which increases production cost.

SUMMARY OF THE INVENTION

It is therefore an object of the invention to provide a display panel and flat display using the same. The display panel and flat display using the same can effectively improve resolution and smoothness of display frames to achieve the purpose of increasing a display effect of the flat display. In the meanwhile the display panel and flat display using the same have features of simple structure and low cost.

The invention achieves the above-identified object by providing a flat display including a substrate, a pixel matrix, a data driver and a number of bias apparatuses. The pixel matrix is disposed on the substrate and includes several columns of first pixels and several columns of second pixels, wherein each column of second pixels is located between two adjacent columns of first pixels. The data driver is for outputting a plurality of data signals to the columns of first pixels. The bias apparatuses are disposed on the substrate, and respectively coupled to the columns of second pixels. Each of the bias apparatuses outputs a bias data signal to the corresponding column of second pixels according to the two data signals outputted to the two columns of first pixels adjacent to the corresponding column of second pixels. Each bias apparatus includes a first load device and a second load device. The first load device has one end coupled to the data driver for receiving one data signal of the corresponding two adjacent data signals. The second load device has one end coupled to the data driver for receiving the other data signal of the corresponding two adjacent data signals and the other end coupled to the other end of the first load device for outputting the corresponding bias data signal.

The invention achieves the above-identified object by providing a display panel including a substrate, a pixel matrix and a number of bias apparatuses. The pixel matrix is disposed on the substrate and includes several columns of first pixels and several columns of second pixels, wherein each column of first pixels receives a data signal and each column of second pixels is located between two adjacent columns of first pixels. The bias apparatuses are disposed on the substrate and respectively coupled to the columns of second pixels. Each bias apparatus outputs a bias data signal to the corresponding column of second pixels according to the two data signals outputted to the two columns of first pixels adjacent to the corresponding column of second pixels. Each bias apparatus includes a first load device and a second load device. The first load device has one end for receiving one data signal of the corresponding two adjacent data signals. The second load device has one end for receiving the other data signal of the corresponding two adjacent data signals and the other end coupled to the other end of the first load device for outputting the corresponding bias data signal.

Other objects, features, and advantages of the invention will become apparent from the following detailed description of the preferred but non-limiting embodiments. The following description is made with reference to the accompanying drawings.

DETAILED DESCRIPTION OF THE INVENTION

The invention provides a flat display which improves frame resolution and smoothness by using a voltage-bias effect of load devices.

Figure 1A:
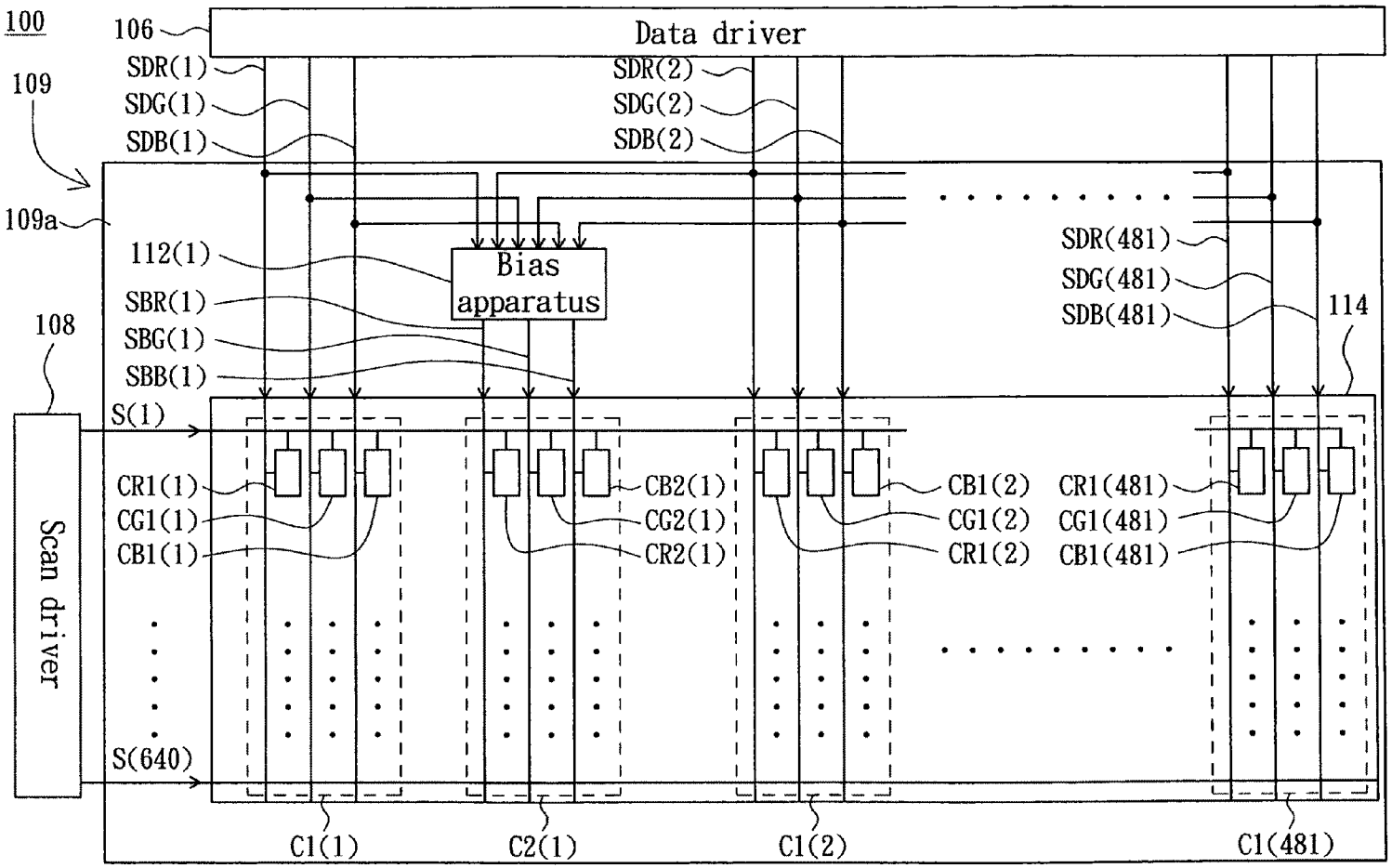
FIG. 1A is a block diagram of a flat display circuit according to a preferred embodiment of the invention.

Referring to FIG. 1A, a block diagram of a flat display circuit according to a preferred embodiment of the invention is shown. A flat display 100, such as a 960 (RGB)*640 voltage-driven flat display, includes a data driver 106, a scan driver 108 and a display panel 109. The display panel 109 includes a substrate 109*a*, bias apparatuses 112(1)~112(480) and a pixel matrix 114.

The pixel matrix 114 includes 481 columns of first pixels C1(1)~C1(481) and 480 columns of second pixels C2(1)~C2(480). Each column of second pixels C2 is located between two adjacent columns of first pixels C1. Each first pixel C1 includes a first red pixel CR1, a first green pixel CG1 and a first blue pixel CB1, and each second pixel C2 includes a second red pixel CR2, a second green pixel CG2 and a second blue pixel CB2.

In the embodiment, the flat display 100 is exemplified to have 481 columns of first pixels C1 and 480 columns of second pixels C2 for illustration convenience. Although the pixel matrix 114 has totally 961 columns of pixels, the practical resolution of the flat display 100 is close to that of a display with 960 columns of pixels. Of course, 481 columns of first pixels C1 and 479 columns of second pixels C2 can also be used to achieve the required 960*640 resolution.

The data driver 106 is used for outputting 481 data signals SD(1)~SD(481) to respectively drive the first pixels C1(1)

~C1(481). The data signals SD(1)~SD(481) are voltage signals and each data signal SD includes red, green and blue data signals SDR, SDG and SDB for respectively driving the corresponding red, green and blue pixels CR, CG and CB.

The bias apparatuses 112(j) (j=1~480) are respectively for receiving the data signals SD(j) and SD(j+1) of the two adjacent columns of first pixels C1(j) and C1(j+1) and accordingly outputting bias data signals SB(j) to the second pixels C2(j). The scan driver 108 is for successively outputting 640 scan signals S(1)~S(640) to enable the first pixels C1(1)~C1(481) and the second pixels C2(1)~C2(480) to respectively receive the data signals SD(1)~SD(481) from the data driver 106 and the bias data signals SB(1)~SB(480) from the bias apparatuses 112(1)~112(480).

Figure 1B:
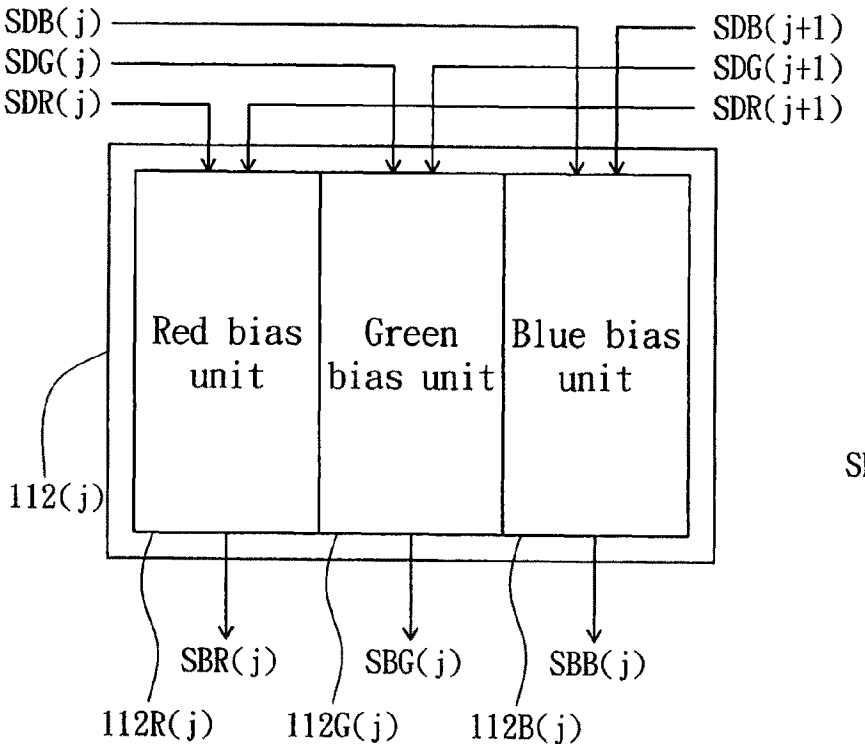
FIG. 1B is a circuit block diagram of the bias apparatus in FIG. 1A.

Besides, as shown in FIG. 1B, each bias apparatus 112G(j) further includes a red bias unit 112R(j), a green bias unit 112G(j) and a blue bias unit 112B(j) for respectively receiving two adjacent red, green and blue data signals SDR(j) and SDR(j+1), SDG(j) and SDG(j+1), and SDB(j) and SDB(j+1), and accordingly outputting red, green and blue bias data signals SBR(j), SBG(j) and SBB(j) to the corresponding second red, green and blue pixels CR2(j), CG2(j) and CB2(j). The red, green and blue bias units 112R, 112G and 112B have similar circuit structure and operational manner.

In the following description, the red bias unit 112R(j) of the bias apparatus 112(j) is taken as an example for illustration, and the circuit structure and operational manner of the green bias unit 112G(j) and blue bias unit 112B(j) can be analogized by the same reason.

Figure 2:
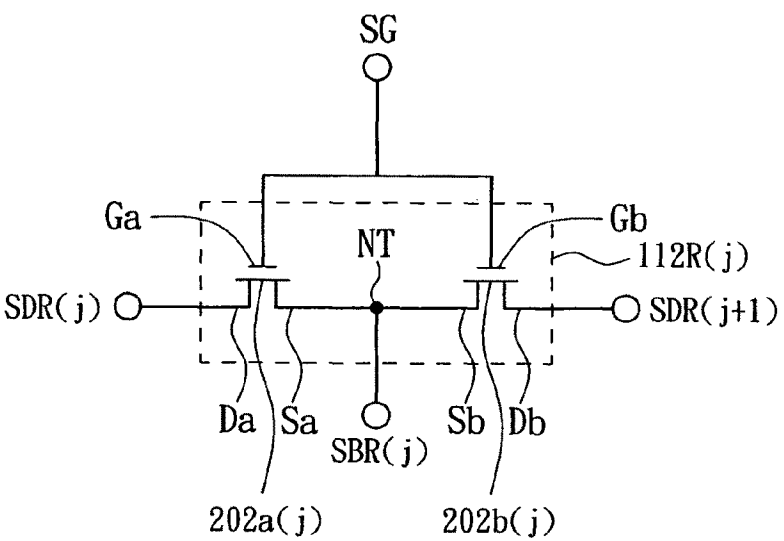
FIG. 2 is a circuit block diagram of the red bias unit in FIG. 1B.

Referring to FIG. 2, a circuit block diagram of the red bias unit 112R(j) in FIG. 1B is shown. The red bias unit 112R(j) includes load devices 202*a*(j) and 202*b*(j). The load devices 202*a*(j) and 202*b*(j) are thin film transistors (TFT) preferably and are exemplified to be N-type metal oxide semiconductor (NMOS) field-effect transistors in the embodiment.

The load devices (transistors) 202*a*(j) and 202*b*(j) have drains Da and Db coupled to the data driver 106 for respectively receiving red data signals SDR(j) and SDR(j+1). The source Sa of the load device (transistor) 202*a*(j) is coupled to the source SB of the load device (transistor) 202*b*(j) to form an output node NT. An operational signal SG, such as a direct-current (dc) voltage signal 15V, is inputted to gates Ga and Gb of the load devices (transistors) 202*a*(j) and 202*b*(j) to turn on the load devices (transistors) 202*a*(j) and 202*b*(j) and a bias operation is performed on the red data signals SDR(j) and SDR(j+1) to output a red bias data signal SBR(j) to the second pixel C2(j) via the output node NT.

According to a voltage-bias principle, the above red bias data signal SBR(j) has a voltage level between voltage levels of the red data signals SDR(j) and SDR(j+1). Practically, a voltage of the bias data signal SBR (SBG or SBB) is determined by equivalent resistance of the load devices (transistors) 202*a*(j) and 202*b*(j). Therefore, channel wide-and-length ratios (W/L) of the load devices (transistors) 202*a*(j) and 202*b*(j) can be adjusted to change resistance of the load devices (transistors) 202*a*(j) and 202*b*(j) so as to adjust the voltage of the outputted bias data signal. The voltage of the bias data signal SBR(j), SBG(j) or SBB(j) is preferably a mean value of voltages of the data signals SDR(j) and SDR(j+1), SDG(j) and SDG(j+1), or SDB(j) and SDB((j+1).

Owing that brightness of the images displayed by adjacent red (green or blue) pixels needs to be continuous, the bias data signal SB(j) generated by performing a voltage-bias operation on the two adjacent data signals SD(j) and SD(j+1) via the two load devices (transistors) 202*a*(j) and 202*b*(j) can just drive the second pixel C2(j) to provide the required red (green or blue) image brightness between that of the first pixels C1(j) and C1(j+1). Therefore, the flat display 100 can simultaneously improve resolution and achieve a smoothness effect of display frames.

Moreover, the above operational signal SG can also be an alternating-current (ac) voltage signal, such as having two successive voltage levels 0V and 10V. By using the ac voltage signal, the stress effect of the load devices (transistors) 202*a*(j) and 202*b*(j) on their threshold voltages can be reduced to increase lifetime of the load devices 202*a*(j) and 202*b*(j). In addition, the load devices 202*a*(j) and 202*b*(j) of the bias apparatus 112 can also be implemented by resistor devices or other load devices with bias function. As long as a voltage-bias operation is performed on the two adjacent data signals to provide a bias data signal to the corresponding second pixel and thus the purpose of improving display resolution can be achieved, all these will not depart from the scope of the invention.

The data driver 106 of the embodiment includes 480*3 channels, and the scan driver 108 includes 640 channels. The pixel matrix 114 includes 960 (RGB)*640 pixels. The required memory volume is 480*640*16 bits. Therefore, without increase of memory volume, resolution of the flat display 100 can be improved by twice. Similarly, without change of resolution, the required memory volume of the flat display 100 in the invention can be reduced to a half.

Figure 3:
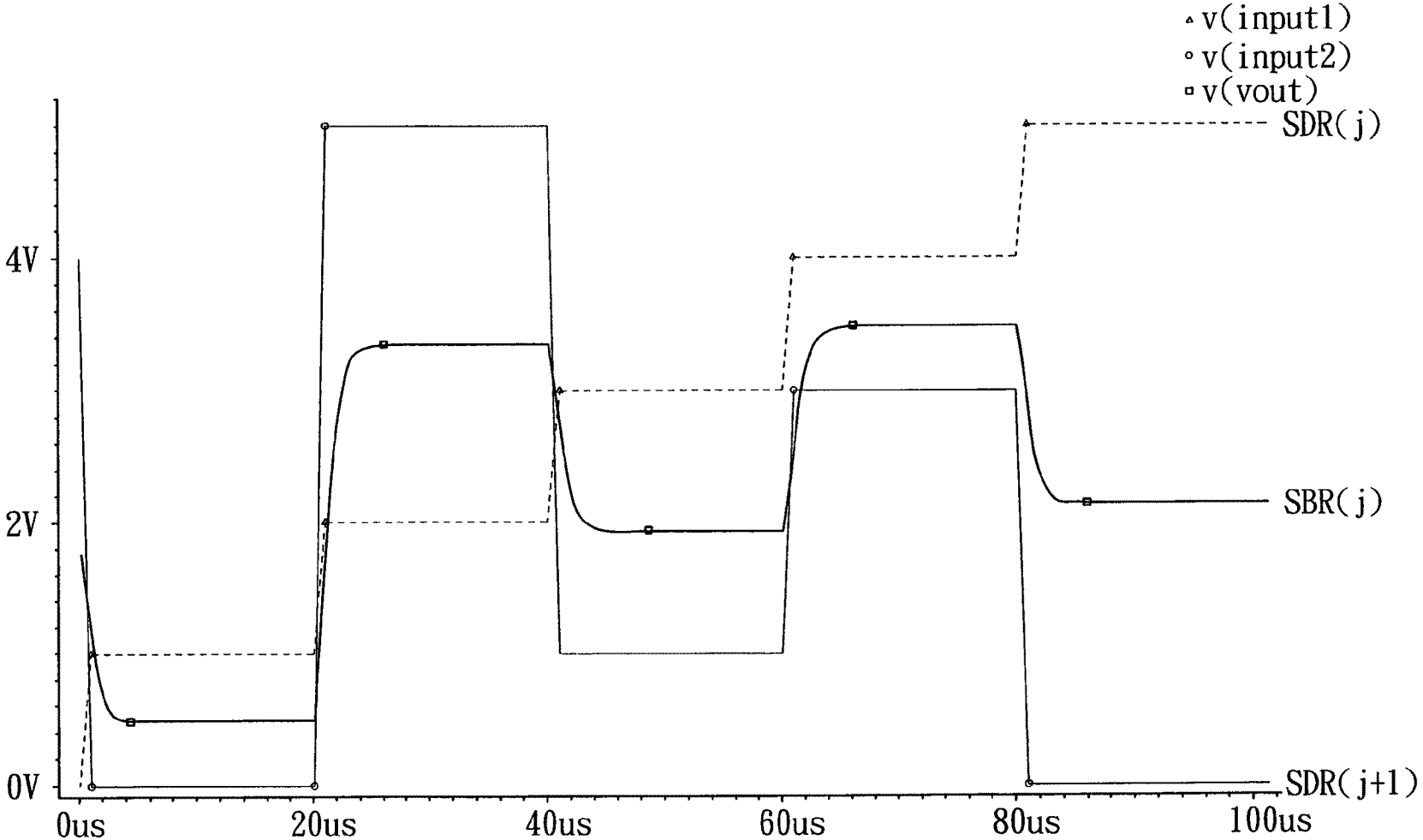
FIG. 3 is a timing diagram of a smart simulation program with integrated circuit emphasis (smart spice) of the red bias data signal in FIG. 2.

Referring to FIG. 3, a timing diagram of a smart simulation program with integrated circuit emphasis (smart spice) of the red bias data signal SBR(j) in FIG. 2 is shown, wherein scan time is 20 us. The flat display 100 has a frame rate 60 Hz and scan time 26 us. In the embodiment, a shorter period of scan time 20 us is used to stimulate 26 us scan time of the flat display 100. The wide/length ratios (W/L) of the load devices 202*a*(j) and 202*b*(j) are both 2000/5 and the operational signal SG is a dc voltage 15V.

The red data signals SDR(j) and SDR(j+1) alter their voltages per 20 us. In a duration between 0 us and 100 us, the red data signal SDR(j) is successively 1V, 2V, 3V, 4V and 5V, the red data signal SDR(j+1) is successively 0V, 5V, 1V, 3V and 0V, and the red bias data signal SBR(j) is successively 0.5V, 3.2V, 2V, 3.5V and 2.3V.

From a stimulation result, it can be seen that the red bias unit 112R(j) formed by the load devices (transistors) 202*a*(j) and 202*b*(j) with the same W/L can provide the second red pixel CR2(j) with the red bias data signal SBR(j) required for a normal operation. The red bias data signal SBR(j) practically has a voltage equal to a mean value of voltages of the red data signals SDR(j) and SDR(j+1).

Figure 4:
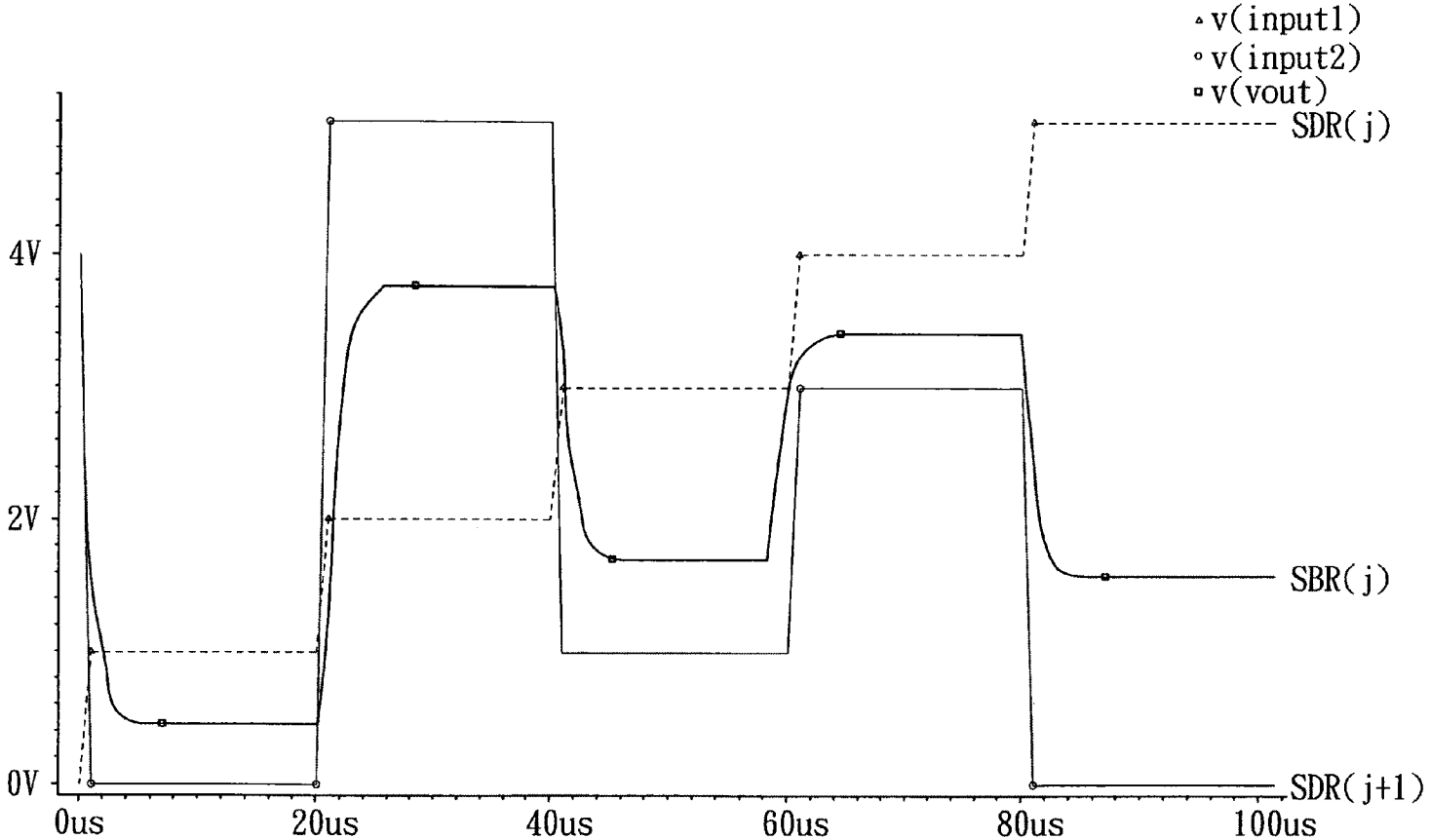
FIG. 4 is another timing diagram of a smart spice of the red bias data signal in FIG. 2.

Besides, supposed the ratios W/L of the load devices 202*a*(j) and 202*b*(j+1) are 1000/5 and 2000/5 respectively, and the operational signal SG remains to be the dc voltage 15V. The red data signals SDR(j) and SDR(j+1) alter their voltage values per 20 us. Similarly, from a stimulation result of FIG. 4, the red bias data signal SBR(j) generated by the red bias unit 112R(j) has a voltage between voltages of the two adjacent red data signals SDR(j) and SDR(j+1) but not the mean value of the latter two voltages. By doing so, a smoothness effect of display frames can also be effectively achieved and display resolution can also be improved.

Figure 5:
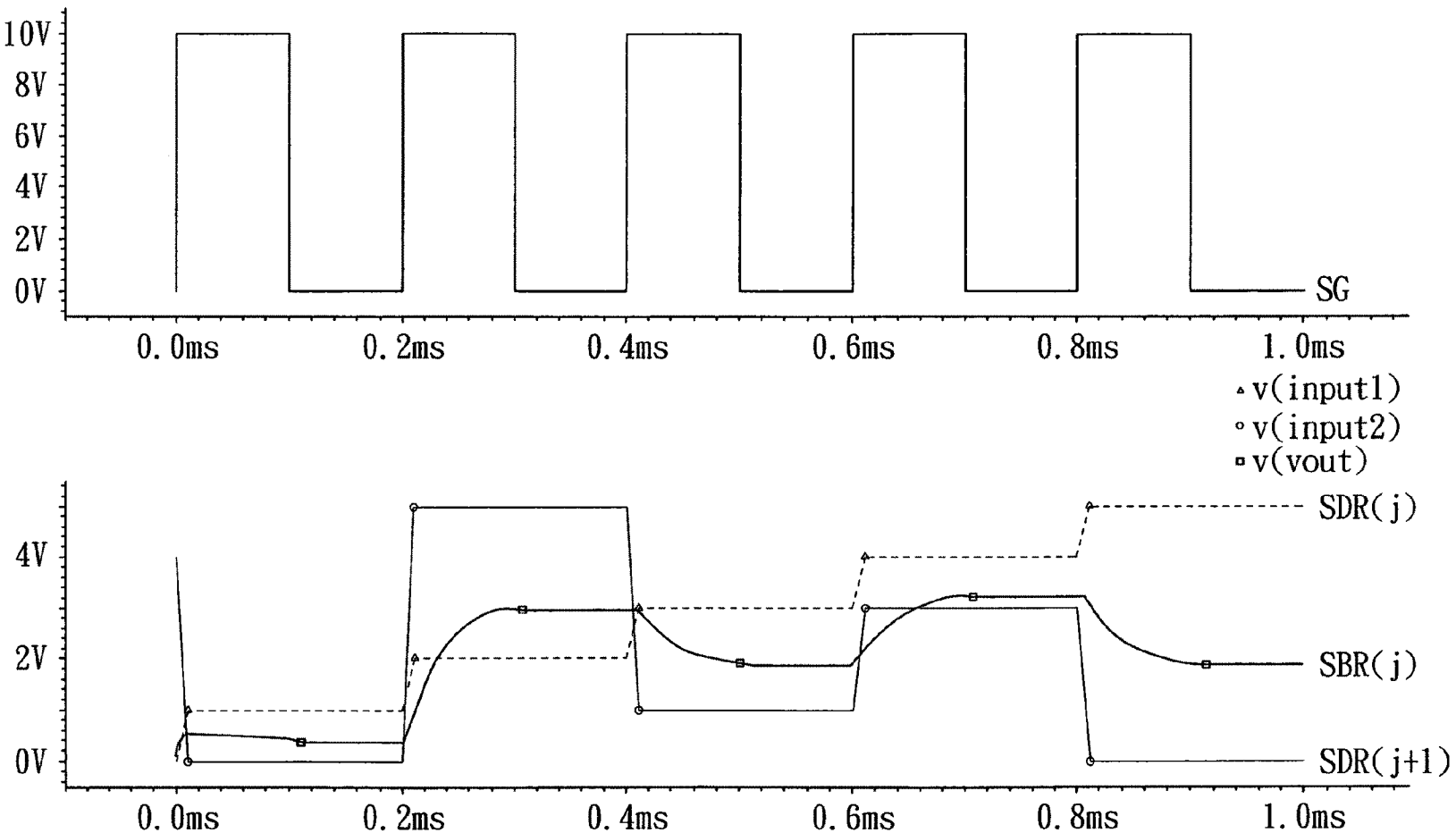
FIG. 5 is a timing diagram of a smart spice of the red bias data signal in FIG. 2 whose operational signal is an ac voltage signal with equally a half period of high and low voltage levels.
Figure 6:
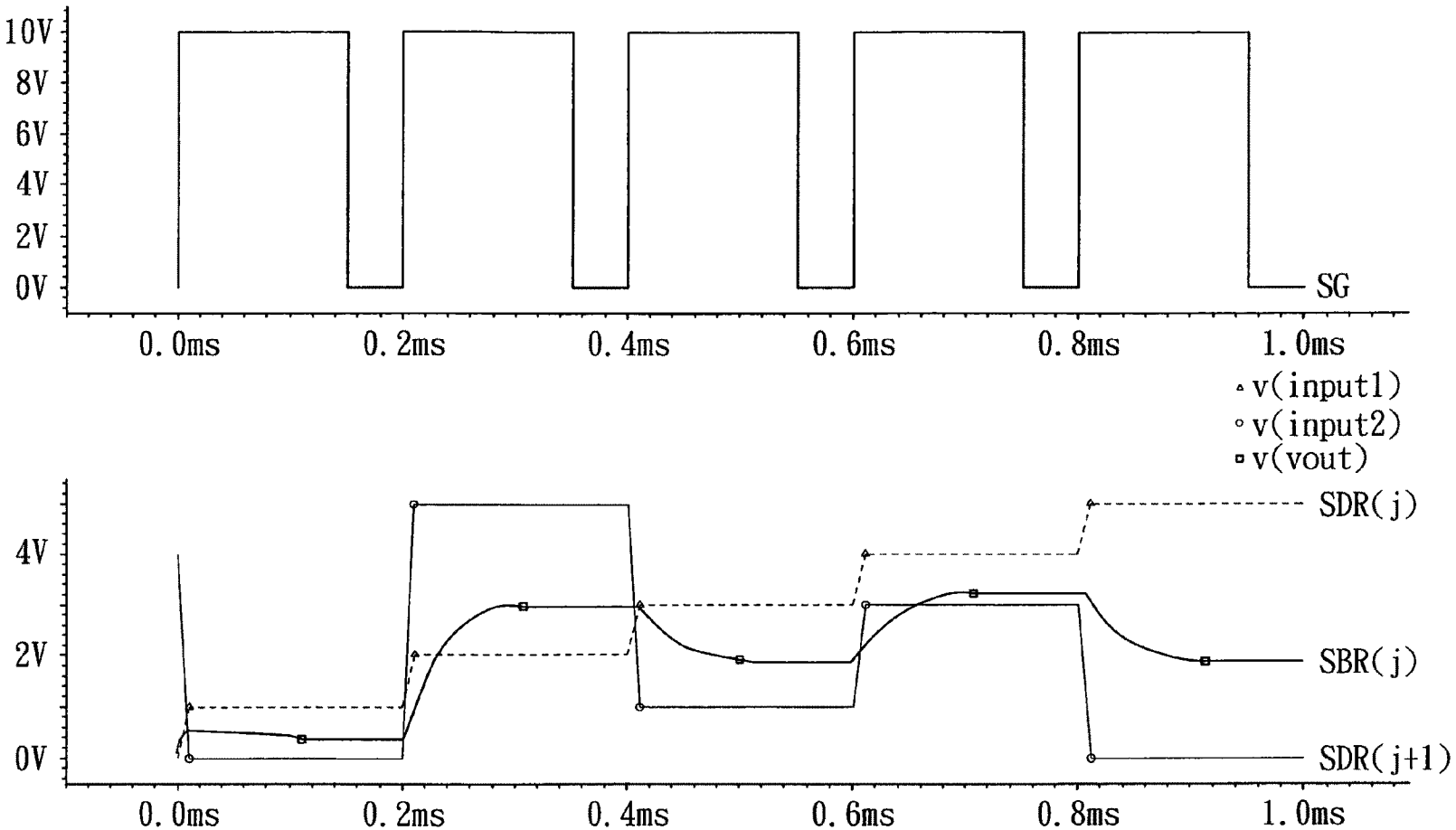
FIG. 6 is a timing diagram of a smart spice of the red bias data signal in FIG. 2 whose operational signal is an ac voltage signal with a three-fourth period of high voltage level and a one-fourth period of low voltage level.

FIG. 5 is a timing diagram of a smart spice of the red bias data signal SBR(j) in FIG. 2 whose operational signal SG is an ac voltage signal with equally a half period of high and low voltage levels. FIG. 6 is a timing diagram of a smart spice of the red bias data signal SBR(j) in FIG. 2 whose operational signal SG is an ac voltage signal with a three-fourth period of high voltage level and a one-fourth period of low voltage level. The red data signal SDR(j) and SDR(j+1) alter voltages per 200 us. From FIG. 5 and FIG. 6, it can be known that the red bias unit 112R(j) can still generate the bias data signal SBR(j) with a voltage between voltages of the two adjacent red data signals SDR(j) and SDR(j+1). Therefore, similarly, a smoothness effect of display frames can be achieved and display resolution can be improved. By using the operational signal SG with an ac voltage, the issue of lifetime reduction of the bias unit due to a stress effect can be solved.

The flat display disclosed by the embodiment uses a bias apparatus with a simple structure to interpolate another data signal according to the two adjacent data signals. Therefore, without increase of memory volume, the resolution and frame smoothness of the flat display can be effectively improved, or without change of resolution, the required memory volume as well as manufacturing cost for the display can be effectively reduced. Therefore, the flat display of the invention can solve the issues of structure complication and high production cost of a conventional flat display.

Figure 7B:
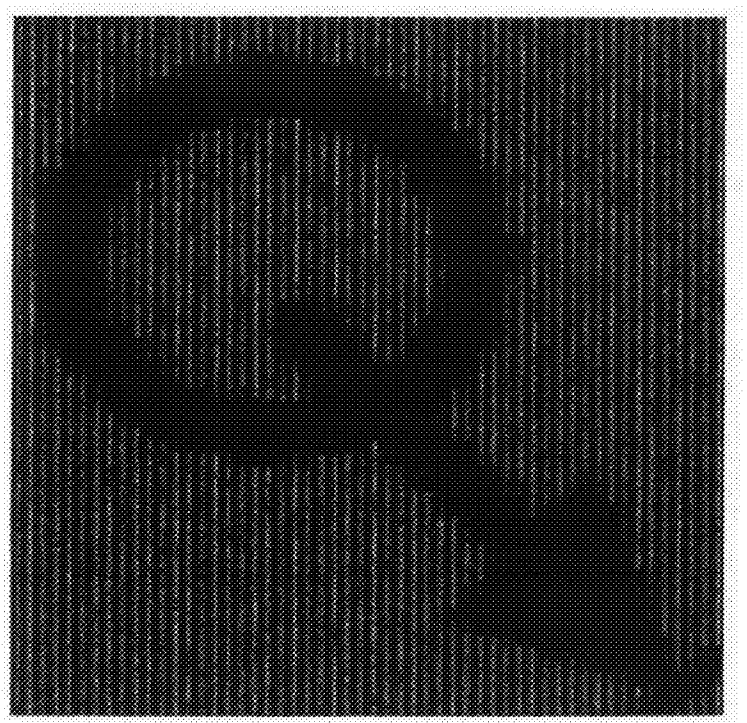
FIG. 7A and FIG. 7B respectively show stimulation results of a display frame according to a conventional flat display and the flat display of the invention.
Figure 7A:
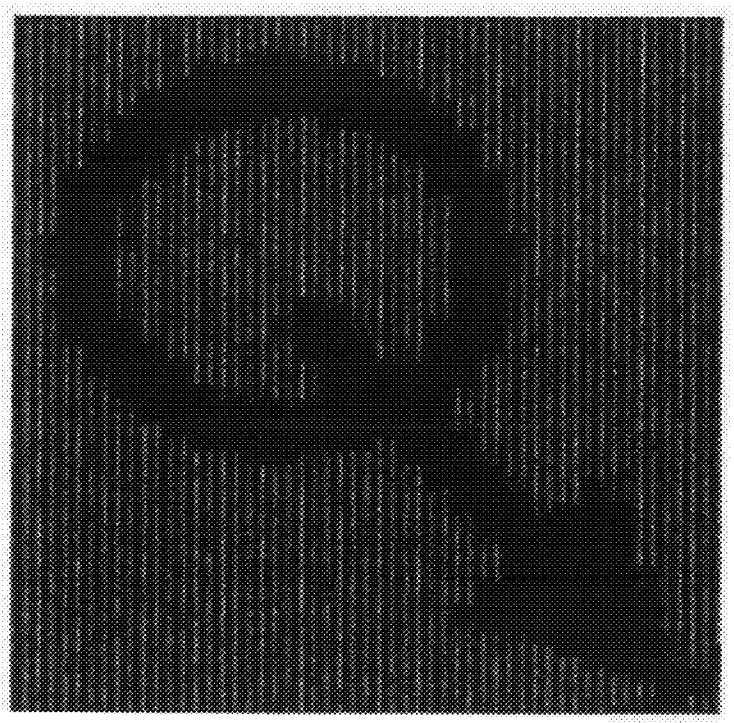

FIG. 7A and FIG. 7B respectively show stimulation results of a display frame according to a conventional flat display and the flat display of the invention. Supposed original display data are 128 (RGB)*128 and the data driver has 64*3 channels, in the stimulation frame of the conventional display, a data line is for displaying data of two data lines in order to generate the required 128*(RGB)*128 as shown in FIG. 7A. The bias apparatus 112 of the flat display 100 in the invention uses data of two adjacent data lines to obtain data of a new data line as shown in FIG. 7B. It can be obviously seen that the resolution and smoothness of the display frame is improved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flat display, comprising:

a substrate;

a pixel matrix, disposed on the substrate, the pixel matrix comprising a plurality of columns of first pixels and a plurality of columns of second pixels, wherein each corresponding column of second pixels is located between two adjacent columns of first pixels;

a data driver, for outputting a plurality of adjacent data signals to the corresponding columns of first pixels; and a plurality of bias apparatuses, disposed on the substrate, and respectively coupled to the columns of second pixels, each of the bias apparatuses outputting a corresponding bias data signal to the corresponding column of second pixels according to a corresponding pair of the plurality of adjacent data signals outputted to the two columns of first pixels adjacent to the corresponding column of second pixels, wherein each of the bias apparatuses comprising:

a first load device, having one end coupled to the data driver for receiving one data signal of said corresponding pair of adjacent data signals; and a second load device, having one end coupled to the data driver for receiving the other data signal of said corresponding pair of adjacent data signals, and a second end coupled to a second end of the first load device for outputting the corresponding bias data signal.

2. The flat display according to claim 1, is a voltage-driven flat display.

3. The flat display according to claim 1, wherein the first load device and the second load device are respectively a first thin film transistor, TFT, and a second TFT.

4. The flat display according to claim 3, wherein input terminals of the first TFT and the second TFT respectively receive a first data signal and a second data signal of said corresponding pair of adjacent data signals, an output terminal of the first TFT is coupled to an output terminal of the second TFT, and control terminals of the first TFT and the second TFT are coupled to an operational voltage.

5. The flat display according to claim 4, wherein the operational voltage is a direct-current voltage and when each of the bias apparatuses receives the corresponding pair of adjacent data signals, the corresponding first TFT and second TFT are both turned on.

6. The flat display according to claim 4, wherein the operational voltage is an alternating-current voltage.

7. The flat display according to claim 1, wherein the first load device and the second load device are both resistor devices.

8. The flat display according to claim 1, wherein each of the first pixels comprises a first red pixel, a first green pixel and a first blue pixel, each of the second pixels comprises a second red pixel, a second green pixel and a second blue pixel, the data driver outputs a plurality of corresponding adjacent red data signals, green data signals, and blue data signals to the first red pixel, the first green pixel, and the first blue pixel respectively, each of the bias apparatuses comprises a red bias unit, a green bias unit and a blue bias unit, and a first load device and a second load device of each of the red unit, green unit, and blue unit receive said corresponding pair of adjacent red data signals, green data signals, and blue data signals respectively and accordingly output red, green, and blue bias data signals to the second red pixel, second green pixel, and second blue pixel respectively.

9. The flat display according to claim 1, wherein each of the bias data signals has a voltage level equal to an average value of voltage levels of said corresponding pair of adjacent data signals.

10. The flat display according to claim 1, wherein a column number of the column of the first pixels is close to a column number of the column of the second pixels.

11. A display panel, comprising:

a substrate;

a pixel matrix, disposed on the substrate, the pixel matrix comprising a plurality of columns of first pixels and a plurality of columns of second pixels, wherein each column of first pixels receives a data signal and each column of second pixels is located between two corresponding adjacent columns of first pixels; and a plurality of bias apparatuses, disposed on the substrate, and respectively coupled to the columns of second pixels, each of the bias apparatuses outputting a corresponding bias data signal to the corresponding column of second pixels according to a corresponding pair of adjacent data signals outputted to the two columns of first pixels adjacent to the corresponding column of second pixels, wherein each of the bias apparatuses comprising:

a first load device, having one end for receiving one data signal of said corresponding pair of adjacent data signals; and a second load device, having one end for receiving the other data signal of said corresponding pair of adjacent data signals, and a second end coupled to a second end of the first load device for outputting the corresponding bias data signal.

12. The display panel according to claim 11, wherein the first load device and the second load device are respectively a first TFT and a second TFT.

13. The display panel according to claim 12, wherein input terminals of the first TFT and the second TFT respectively receive a first and a second data signals of said corresponding pair of adjacent data signals, an output terminal of the first TFT is coupled to an output terminal of the second TFT, and control terminals of the first TFT and the second TFT are coupled to an operational voltage.

14. The display panel according to claim 13, wherein the operational voltage is a dc voltage and when each of the bias apparatuses receives the corresponding pair of adjacent data signals, the corresponding first TFT and second TFT are both turned on.

15. The display panel according to claim 13, wherein the operational voltage is an ac voltage.

16. The display panel according to claim 11, wherein the first load device and the second load device are both resistor devices.

17. The display panel according to claim 11, wherein each of the first pixels comprises a first red pixel, a first green pixel and a first blue pixel, each of the second pixels comprises a second red pixel, a second green pixel and a second blue pixel, the data driver outputs a corresponding plurality of adjacent red, green, and blue data signals to the first red, green, and blue pixels, each of the bias apparatuses comprises a red bias unit, a green bias unit and a blue bias unit, and a first load device and a second load device of each of the red, green, and blue units receive said corresponding pair of the plurality of adjacent red data signals, green data signals, and blue data signals respectively and accordingly output a corresponding red, green, and blue bias data signals to the corresponding second red, green, blue pixels respectively.

18. The display panel according to claim 11, wherein each of the corresponding bias data signals has a voltage level equal to an average value of voltage levels of said corresponding pair of the plurality of adjacent data signals.

* * * * *